US006939129B2

(12) United States Patent
Hsu

(10) Patent No.: US 6,939,129 B2
(45) Date of Patent: Sep. 6, 2005

(54) IGNITION GUN WITH SAFETY SWITCH

(76) Inventor: Huang-Hsi Hsu, 8F, No. 14, Lane 252, Chungshan N. Rd., Sec. 6, Taipei (TW)

( * ) Notice: Subject to any disclaimer, the term of this patent is extended or adjusted under 35 U.S.C. 154(b) by 53 days.

(21) Appl. No.: 10/619,416

(22) Filed: Jul. 16, 2003

(65) Prior Publication Data

US 2005/0014101 A1 Jan. 20, 2005

(51) Int. Cl.[7] ..... F23D 11/36
(52) U.S. Cl. ..... 431/153; 431/255
(58) Field of Search ..... 431/153, 255, 431/277, 343, 344, 345

(56) References Cited

U.S. PATENT DOCUMENTS 5,460,521 A * 10/1995 Tsai ..... 431/255
5,829,963 A * 11/1998 Ichikawa ..... 431/153
5,839,892 A * 11/1998 Hwang ..... 431/153
5,897,308 A * 4/1999 Saito et al. ..... 431/153
6,086,358 A * 7/2000 Potskhishvili et al. ..... 431/153
6,146,129 A * 11/2000 Li ..... 431/153
6,217,313 B1 * 4/2001 Luo ..... 431/153
6,231,335 B1 * 5/2001 Huang ..... 431/153
6,287,109 B1 * 9/2001 Hirota ..... 431/153
6,296,476 B1 * 10/2001 Tsai ..... 431/153
6,520,768 B1 * 2/2003 Hsu ..... 431/153
6,551,097 B1 * 4/2003 Huang ..... 431/153
6,612,832 B1 * 9/2003 Huang ..... 431/153
6,616,443 B2 * 9/2003 Saito et al. ..... 431/153
6,641,389 B1 * 11/2003 Huang ..... 431/153
6,666,677 B1 * 12/2003 Ichikawa et al. ..... 431/153

* cited by examiner

*Primary Examiner*—Carl D. Price
(74) *Attorney, Agent, or Firm*—Bacon & Thomas

(57) ABSTRACT

An ignition gun device with safety switch. The device includes a hollow body with a safety switch near its center. The safety switch includes a body and a pressing part. The pressing part is placed freely onto the top of the body to move forward or backward. A brake bar is installed freely inside the pressing part to prevent the pressing part from moving forward. A brim of the hollow body is positioned corresponding to the connection of the safety switch. The brim blocks a pressing brim on the bottom of the pressing part to prevent the safety switch from being pushed down. During ignition, users have to move the brake bar to the blocking position and push the pressing part forward. The pressing brim then moves away from the brim enabling users to press down the safety switch to ignite the flame for safer and more convenient usage.

4 Claims, 7 Drawing Sheets

IGNITION GUN WITH SAFETY SWITCH

BACKGROUND OF THE INVENTION

I. Field of the Invention

This invention relates generally to an ignition gun with safety switch and, more specifically, to an ignition gun that users have to press the safety switch first to start the piezo-electric unit for flame.

II. Description of the Prior Art

Heretofore, it is known that an ignition (as shown in FIG. 1) has a rectangular shell body (10), a tube (12) stretches out from one side of the shell body (10), a gas tank (14) and a piezo-electric unit (16) are inside the shell body (10); a gas outlet (142) is on top of the gas tank (14), a soft tube (144) connects to the gas outlet (142), the other side of the soft tube (144) stretches out to the top of the tube (12) and connects to the ignition area (not shown in FIG.) of the ignition (1); a pulling board (146) is on the proper location of the gas outlet (142) of the gas tank (14), an orientation hole (18) is on the proper location of the shell body (10), a pressing part (19) is inside the orientation hole (18) and exposes external to the shell body (10), the bottom of the pressing part (19) touches to the starter (162) of the piezo-electric unit (16), one end of the electrode of the piezo-electric unit (16) connects to the ignition point of the ignition (1), the other end of the electrode connects to the inner brim of the tube (12) to form a ignition loop.

Referring to FIG. 1, a brake mechanism (2) is above the pressing part (19) and gas tank (14), a moveable body (20) of the brake mechanism (2) is inside the shell body (10); a turning rod (not shown in FIG) corresponding to the moveable body (20) is external to the shell body (10), one side of the turning rod passes through the shell body (10) and connects to the moveable body (20), the other end of the turning rod has a convex for users to move; a elastic part is on one side of the turning rod (not shown in FIG.), one side of the elastic part is against on one side the moveable body (20), the other end of the elastic part is fixed on the inner side of the shell body (10); when the strength of the turning rod is released, the bounce back power can return the turning rod back; a linking rod (24) links freely to the moveable body (20) and locates near the pressing part (19), a second elastic part (242) is on the linking rod (24), the pressure of the linking rod (24) is released, the second elastic part (242) can push the linking rod (24) back to the original.

By above structure, when users turn the turning rod of the brake mechanism (2) and move the linking rod (24) to above the gas tank (14), referring to FIG. 1, users press pressing part (19), the pressing part (19) brings the linking rod (24) downward to press the pulling board (146), the pulling board (146) pulls the gas outlet (142) of the gas tank (14), the gas of the gas tank (14) flows through the soft tube (144) to ignition area; at the same time the pressing part (19) presses the starter (162) of the piezo-electric unit (16) to make the piezo-electric unit (16) generates a discharge spark and ignites the gas; when the turning rod is not moved, the linking rod (24) is not on the gas tank (14) position, even if users press the pressing part (19) can only generate discharge spark by the piezo-electric unit (16) and can not have the gas of the gas tank (14) flow into the soft tube (144), no discharge spark is on. The safety mechanism can prevent carelessly press the pressing part (19) to turn on discharge spark and generate accident.

When the ignition (1) is in use, the turning rod might not be moved along easily, the linking rod (24) can not go to top of the gas tank (14), while the pressing part (19) is pressed can only have the piezo-electric unit (16) generate discharge spark without turning on discharge spark, that makes users very inconvenient and disturbing. The ignition (1) can achieve safety purpose but also cause inconvenience.

SUMMARY OF THE INVENTION

It is therefore a primary object of the invention to provide an ignition gun with safety switch comprising a hollow body with a safety switch near center, the safety switch consists of a body and a pressing part, the pressing part is placed freely onto the top of the body to move forward or backward, a brake bar installed freely inside the pressing part to prevent the pressing part from moving forward, a brim of the hollow body locates corresponding to the connection of the safety switch, the brim blocks the pressing brim on the bottom of the pressing part to prevent the safety switch from being pushed down; while ignition, users have to move the brake bar to the blocking position and push the pressing part forward, the pressing brim on the bottom of the pressing part moves away from the brim of the hollow body first, then users can press down the safety switch to ignite the flame for safer and more convenient purpose.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
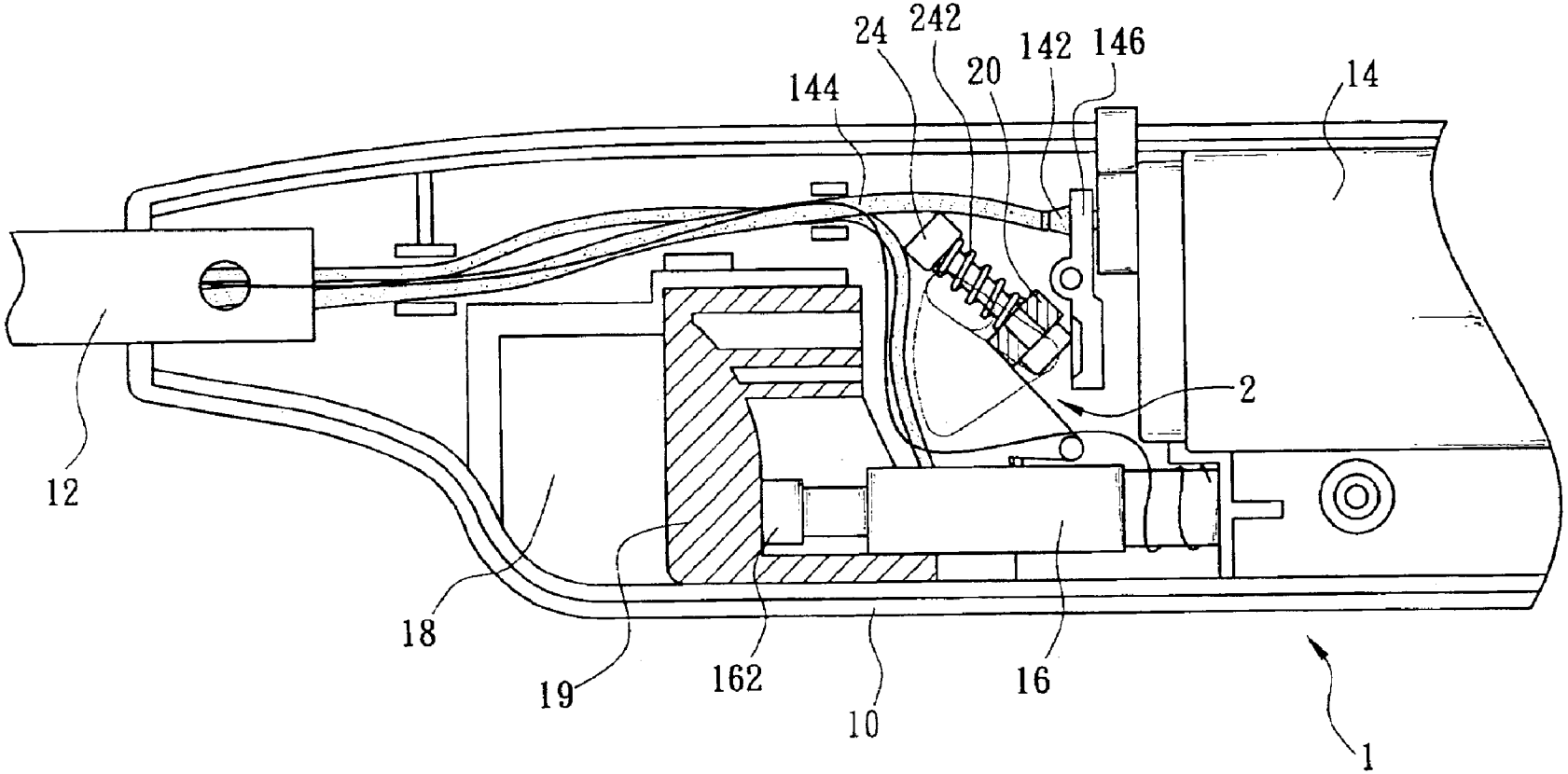
FIG. 1 (Prior Art)
FIG. 1 is a perspective view of the prior art.
Figure 2:
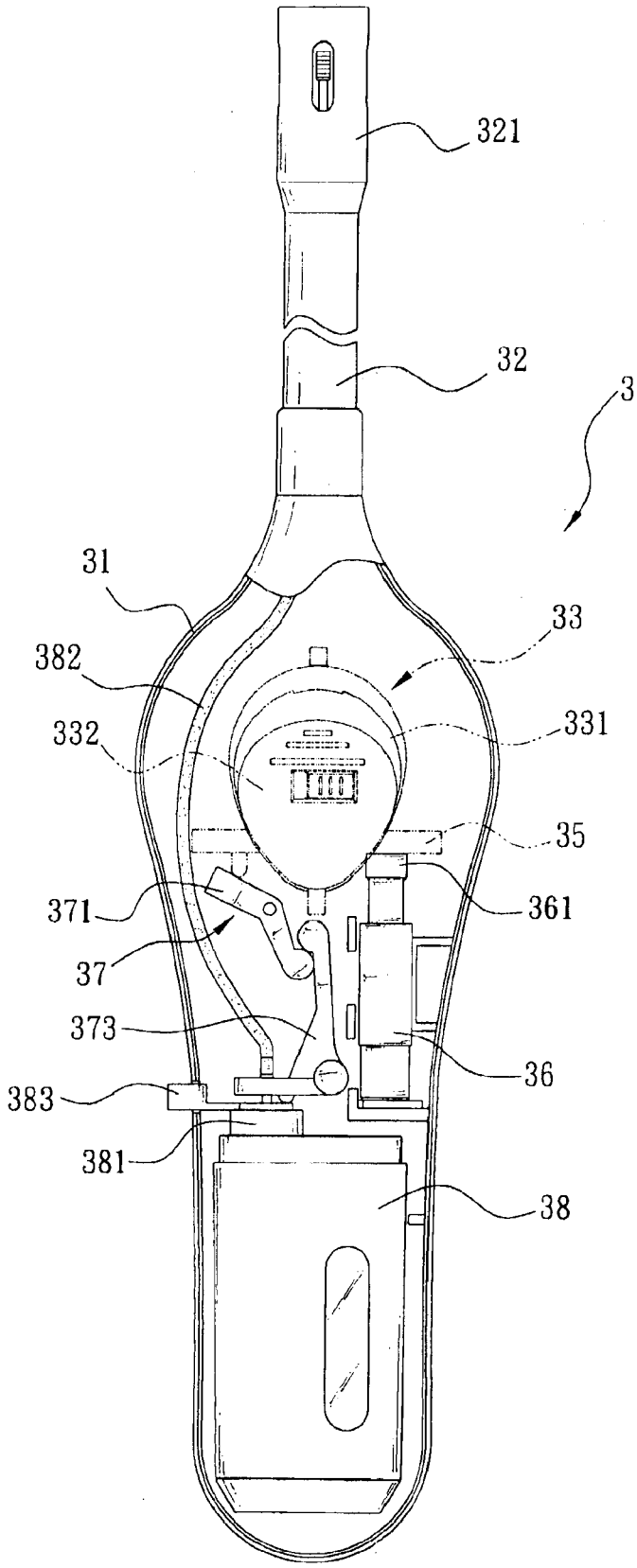
FIG. 2 is a perspective view of the present invention.
Figure 3:
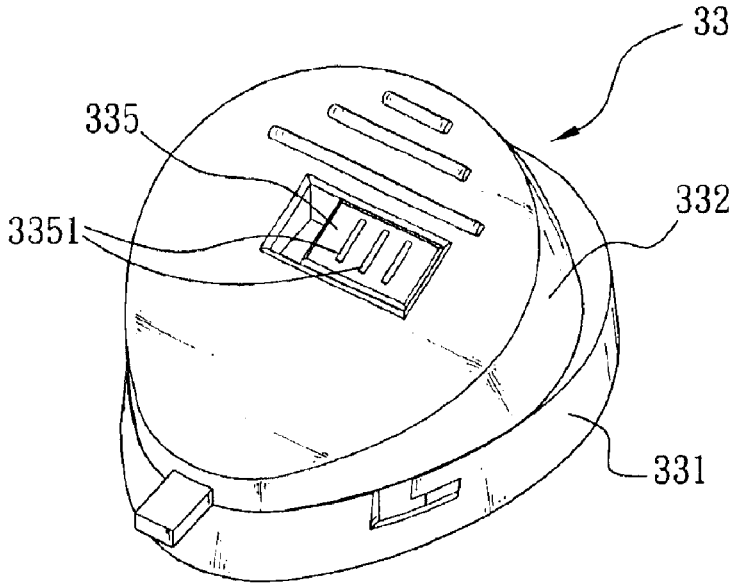
FIG. 3 is a front view of the safety switch of the present invention.
Figure 4:
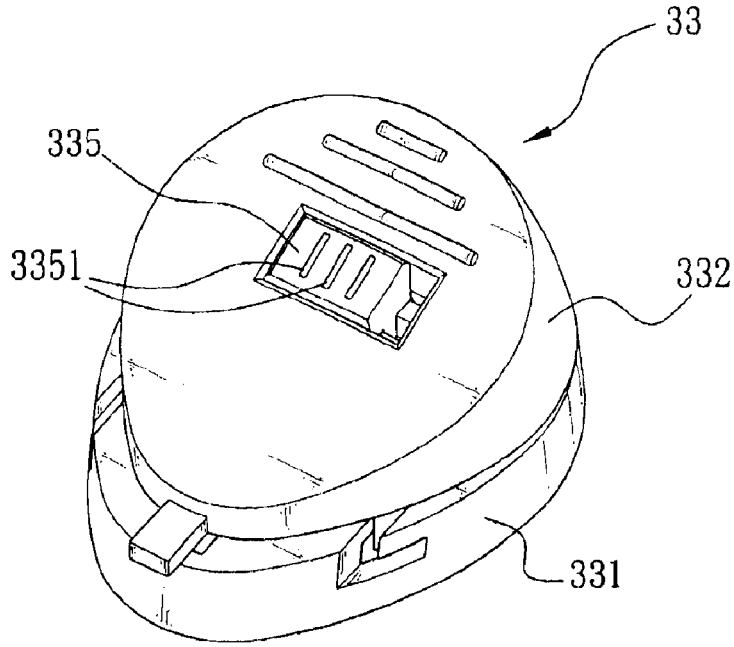
FIG. 4 is an application view of the safety switch of the present invention.

Referring to FIG. 2, the present invention is composed of a hollow body (31) gripable by users, a tube (32) stretches out from one side of the hollow body (31), a ignition area (321) in on the end of the tube (32), an opening is on the top center of the hollow body (31), a safety switch (33) is on the opening, one end of the safety switch (33) is connected on the inner side of the hollow body (31) to let the free end of the safety switch (33) to be pressed downward. Referring to FIG. 3 and FIG. 4, the safety switch (33) consists of a body (331) and a pressing part (332), the pressing part (332) is placed freely onto the top of the body (331), when the pressing part (332) is pushed, it can move forward or backward on top of the body (331) (as shown in FIG. 7, FIG. 8), referring to FIG. 3 and FIG. 5, a brake bar (335) is freely inside the pressing part (332), the top of the brake bar (335)

exposes externally to the opening of the pressing part (332), the bottom of the brake bar (335) is against the stopper (337) of the body (331), the pressing part (332) can not move forward or backward for the stopper (337) blocks the brake bar (335). Referring to FIG. 7, a brim (34) of the hollow body (31) locates corresponding to the connection of the safety switch (33), the brim (34) blocks the pressing brim (333) on the bottom of the pressing part (332), the safety switch (33) can not be pushed down by the block of the brim (34) to avoid careless pressing of the safety switch (33) that causes accident.

Figure 7:
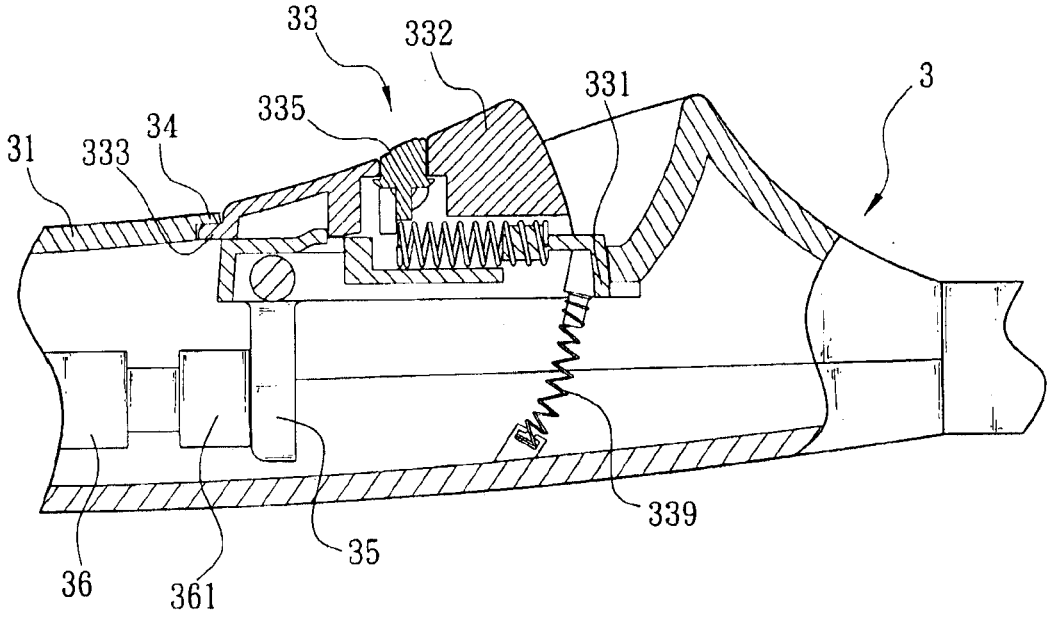
FIG. 7 is a cross-sectional view of the present invention.
Figure 8:
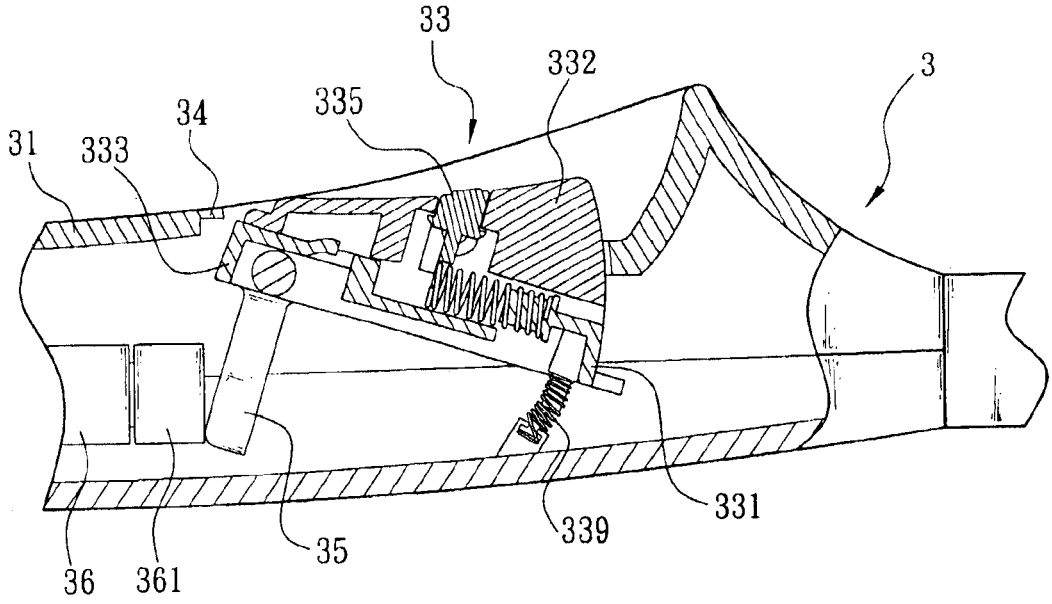
FIG. 8 is another cross-sectional view of the present invention.

Referring to FIG. 2, FIG. 7 and FIG. 8, a starting bar (35) stretches downward and locates on the bottom of the free end of the safety switch (33), one side of the starting bar (35) connects to the starter (361) of the piezo-electric unit (36) of the ignition (3), the other side of the starting bar (35) connects to the gas outlet (37); the other side of the gas outlet (37) connects to the gas valve (381) of the gas tank (38); a gas tube (382) is on the gas valve (381) of the gas tank (38), the other side of the gas tube (382) stretches to the end of the tube (32) of the ignition (3) and connects to the ignition area (321) in on the end of the tube (32); the piezo-electric unit (36) connects to the ignition area (321) of the tube (32) with a wire and connects to the inner side of the tube (32) with another wire to form a discharge spark generating loop, when the safety switch (33) is pressed down to activate the starting bar (35) triggering the starter (361) of the piezo-electric unit (36) and the gas outlet (37), the piezo-electric unit (36) generates discharge spark at the ignition area (321) of the ignition (3), at the same time the gas outlet (37) pulls out the gas valve (381) of the gas tank (38), the gas of the gas tank (38) flows to the ignition area (321), flame is generated.

At the ignition time, referring to FIG. 5, FIG. 6, FIG. 7 and FIG. 8, users have to push the brake bar (335) out of the blocking location of the stopper (337), and move the pressing part (332) to have the pressing brim (333) away from the brim (34) of the hollow body (31), users then can push the safety switch (33) for ignition. Users have to grip the ignition (3) with one hand and press the safety mechanism of the safety switch (33) with another hand to push the safety switch (33) for ignition for safer and more convenient purpose.

In the above application, referring to FIG. 2, the gas outlet (37) has a trigger (371) and an gas lever (373), the center of the trigger (371) connects to the inner brim of the hollow body (31) of the ignition (3), one side of the trigger (371) touches the starting bar (35) of the safety switch (33), the other side of the trigger (371) touches one end of the gas lever (373); the right angle portion of the gas lever (373) connects to the inner brim of the hollow body (31) of the ignition (3), one side of the gas lever (373) touches the trigger (371), the other side of the gas lever (373) connects to the gas valve (381) of the gas tank (38), when the safety switch is pressed downward, the starting bar (35) can press the trigger (371) and push the gas lever (373) to pull the gas valve (381) of the gas tank (38) open.

Referring to FIG. 3 and FIG. 4, a plurality numbers of slippage-proof stripe (3351) are on the top of the brake bar (335); when users push the brake bar (335), the slippage-proof stripe (3351) increases the friction between fingers and the brake bar (335) so users can push the brake bar (335) easier.

Referring to FIG. 2, a regulator is installed on the connection between the gas valve (381) and the gas tank (38), an adjustable rod (383) is on the regulator, the adjustable rod (383) exposes from the hollow body (31) that is farther from the other side gas tank (38), the adjustable rod (383) can adjust flow of gas from the gas tank (38).

Referring to FIG. 3, a gas inlet valve (not shown in FIG) is on the gas tank (38) that located on the other side of the gas valve (381), an open hole of the body (31) that corresponding to the gas inlet valve so the gas charging tank can have the inlet tube pass through the opening and connect to the gas inlet valve to inflate gas into the gas tank (38), users do not have to throw away the empty gas tank (38) to cause waste.

Referring to FIG. 7 and FIG. 8, the back of the safety switch (33) connects to the inner side of the hollow body (31) so the front end of the safety switch (33) can be pressed downward, a brim (34) is on the hollow body (31) corresponding to the safety switch (33), the brim (34) blocks the pressing brim (333) on the back bottom of the pressing part (332); while ignition, referring to FIG. 5, FIG. 6, FIG. 7 and FIG. 8, users have to move the brake bar (335) out of the blocking location of the stopper (337), then move the pressing part (332) forward and have the pressing brim (333) of the pressing part (332) away from the brim (34) of the hollow body (31) to press down safety switch (33) and ignite.

Figure 5:
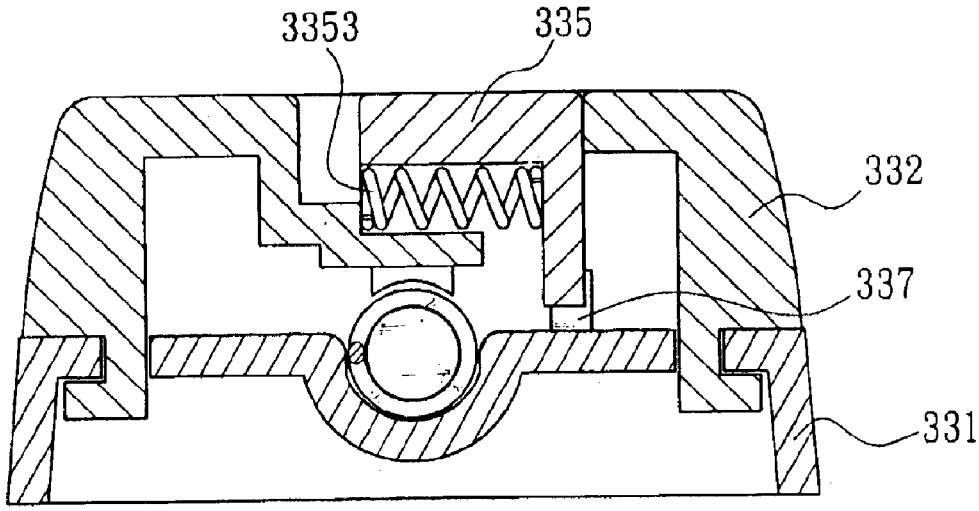
FIG. 5 is an application view of the brake bar with the present invention.
Figure 6:
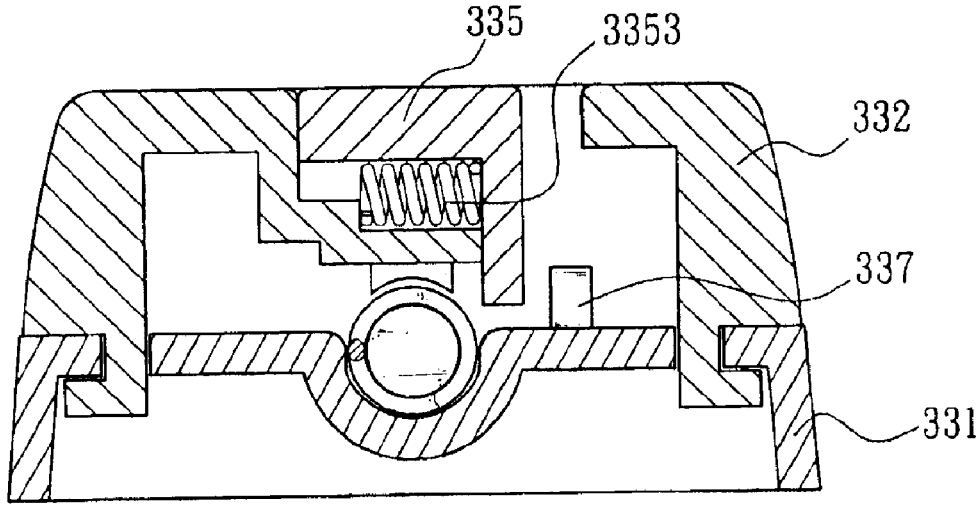
FIG. 6 is another application view of the brake bar with the present invention.

Referring to FIG. 5 and FIG. 6, an elastic component (3353) (spring for example) is between the brake bar (335) and the pressing part (332), the elastic component (3353) can have the brake bar (335) back to the original location after being moved.

Referring to FIG. 7 and FIG. 8 again for this embodiment, an elastic member (339) is disposed between the body (331) of the safety switch (33) and the inner side of the hollow body (31), such that the elasticity of the elastic member (339) is used to press the safety switch (33) downward, and then return itself back to the original position.

Figure 9:
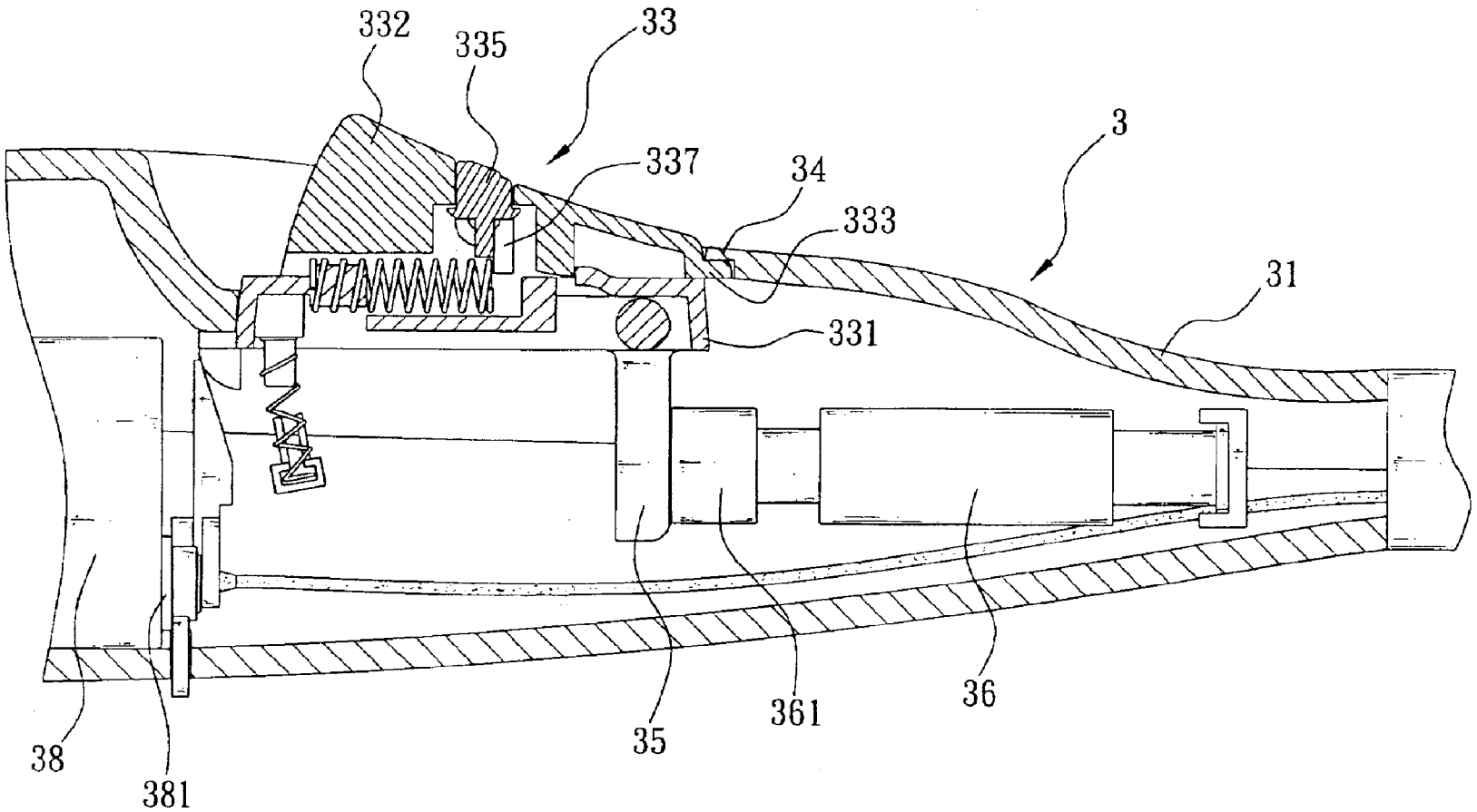
FIG. 9 is an application view of the present invention.

Referring to FIG. 9, the front end of the safety switch (33) is connected on the inner side of the hollow body (31) to let the free end of the safety switch (33) to be pressed downward, a brim (34) of the hollow body (31) locates corresponding to the connection of the safety switch (33), the brim (34) blocks the pressing brim (333) on the bottom of the pressing part (332); the starting bar (35) locates on the bottom of the front end of the safety switch (33), one side of the starting bar (35) connects to the starter (361) of the piezo-electric unit (36), the end bottom of the safety switch (33) connects to one side of a pulling board, the other side of the pulling board connects to the gas valve (381) of the gas tank (38), while ignition, referring to FIG. 5, FIG. 6 and FIG. 9, users have to push the brake bar (335) away from the location corresponding to the stopper (337), and move the pressing part (332) backward to have the pressing brim (333) on the front bottom of the pressing part (332) away from the brim (34) of the hollow body (31), then users can press down safety switch (33) to start the ignition.

Figure 10:
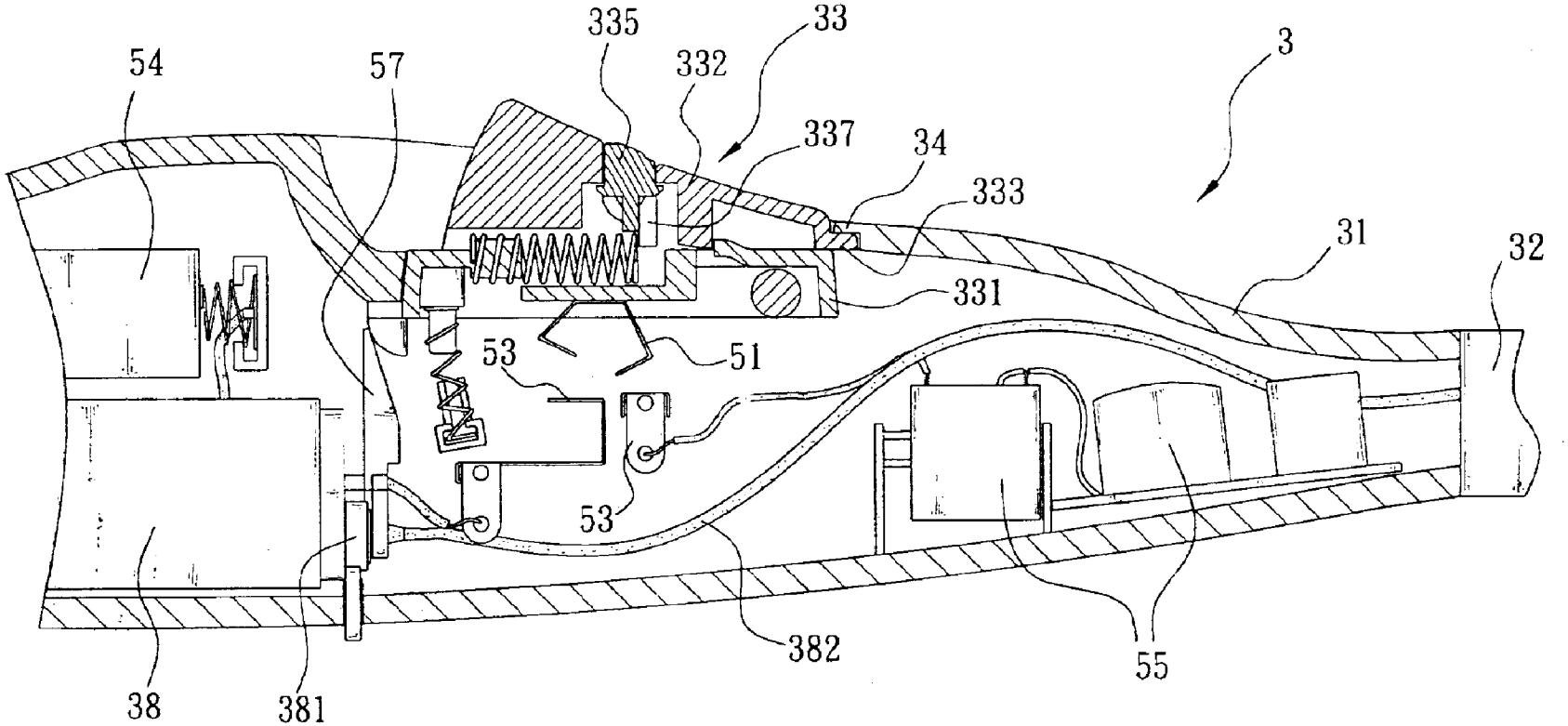
FIG. 10 is another application view of the present invention.

Referring to FIG. 10, another application example, the ignition (3) consists of a hollow body (31) gripable by users, a tube (32) stretches out from one side of the hollow body (31), a ignition area (not shown in FIG.) in on the end of the tube (32), an opening is on the top center of the hollow body (31), a safety switch (33) is on the opening, one end of the safety switch (33) is connected on the inner side of the hollow body (31) to let the free end of the safety switch (33) to be pressed downward. The safety switch (33) consists of a body (331) and a pressing part (332), the pressing part (332) is placed freely onto the top of the body (331), when the pressing part (332) is pushed, it can move forward or backward on top of the body (331), a brake bar (335) is freely inside the pressing part (332), the top of the brake bar (335) exposes externally to the opening of the pressing part (332), the bottom of the brake bar (335) is against the stopper (337) of the body (331), the pressing part (332) can not move forward or backward for the stopper (337) blocks the brake bar (335). A brim (34) of the hollow body (31) locates corresponding to the connection of the safety switch (33), the brim (34) blocks the pressing brim (333) on the bottom of the pressing part (332), the safety switch (33) can not be pushed down by the block of the brim (34) to avoid careless pressing of the safety switch (33) that causes accident.

Referring to FIG. 2 and FIG. 10, a conducting plate (51) in "Ω" shape is on the bottom of the safety switch and stretches downward, the two ends of the conducting plate (51) correspond to the two connection (53) of the ignition (3), one of the connection (53) connects to a battery (54), the other connection (53) connects to the high voltage generator (55) of the ignition (3), the high voltage generator (55) connects to the ignition area of the ignition (3) with a wire and connects to the inner side of the tube (32) with another wire to generate a discharge spark loop, when the two ends of the conducting plate (51) connect to two connection (53), the battery (54) connects to the high voltage generator (55), the battery (54) offers electrical power to the high voltage generator (55), the high voltage generator (55) can generate discharge spark on the ignition area of the ignition (3). The bottom of the back of the safety switch (33) connects to a gas outlet slab (57), the other side of the gas outlet slab (57) connects to the gas valve (381) and the gas tank (38), a gas tube (382) is on the gas valve (381) of the gas tank (38), one end of the gas tube (382) connects to the gas valve (381), the other end stretches to end of the tube (32) and connects to the ignition area of the tube (32); when the safety switch (33) is pressed downward, the conducting plate (51) of the safety switch (33) connects to two connection (53) such that the high voltage generator (55) generates an pilot fire on the ignition area (321) of the ignition (3). In the meantime, the safety switch (33) presses the outlet slab (57) such that the outlet slab (57) pulls open the gas valve (381) of the gas tank (38) to flow the gas into the ignition area (321) through the gas tube (382) and the pilot fire on the ignition area (321) of the ignition (3) generate sparks and ignite the flame.

At the ignition time, referring to FIG. 5, users have to push the brake bar (335) out of the blocking location of the stopper (337), and move the pressing part (332) to have the pressing brim (333) away from the brim (34) of the hollow body (31), users then can push the safety switch (33) for ignition. Users have to grip the ignition (3) with one hand and press the safety mechanism of the safety switch (33) with another hand to push the safety switch (33) for ignition for safer and more convenient purpose.

While a preferred embodiment of the invention has been shown and described in detail, it will be readily understood and appreciated that numerous omissions, changes and additions may be made without departing from the spirit and scope of the invention.

What is claimed is:

1. An ignition gun comprising:

a hollow body with a tube that stretches out from one side of the hollow body;

a safety switch located on a center opening of said hollow body, one end of said safety switch connected on an inner side of said hollow body to allow a free end of said safety switch to be pressed downward, said safety switch comprises a body, a pressing brim and a pressing part, said pressing part is positioned on top of said body to move forward or backward;

a brake bar installed inside said pressing part, a top of said brake bar is in contact with said pressing part, a bottom of said brake bar is pressed against a stopper, movement of said pressing part is restricted by said stopper, a brim of the hollow body permits access to said safety switch, said brim blocks the pressing brim by engaging a top surface of said pressing brim to prevent said safety switch from being pushed down;

a starting bar stretching downward and located on a bottom of the free end of said safety switch;

a piezo-electric unit located inside said hollow body, a starter of said piezo-electric unit connects to said starting bar, said piezo-electric unit connects to an ignition area of the tube;

a gas outlet, one side of said gas outlet connecting to said starting bar, another side of said gas outlet connecting to an outlet of a gas valve of a gas tank;

a gas tube located on the gas valve of the gas tank and one open end connected to the outlet of said gas valve, another open end of said gas tube connects to said ignition area; and said gas outlet comprising a trigger and a gas lever, a center of said trigger connects to the brim of said hollow body, one side of said trigger touches said starting bar of said safety switch, a right angle portion of said gas lever connects to the brim of said hollow body, one side of said gas lever touches said trigger, another side of said gas lever connects to said gas valve of the gas tank.

2. The ignition gun with safety switch as recited in claim 1, further comprising a plurality of slippage-proof stripes located on top of said brake bar.

3. The ignition gun with safety switch as recited in claim 2, further comprising a regulator installed between said gas valve and the gas tank, said regulator comprises an adjustable rod, said adjustable rod extends out of the hollow body, and said adjustable rod adjusts flow of gas from the gas tank.

4. The ignition gun with safety switch as recited in claim 3, further comprising a gas inlet valve located on the gas tank, an open hole of said hollow body corresponds to said gas inlet valve to permit filling of the gas tank.

* * * * *